US011791522B2

(12) United States Patent
Hasegawa

(10) Patent No.: US 11,791,522 B2
(45) Date of Patent: Oct. 17, 2023

(54) BANDPASS FILTER

(71) Applicant: FUJIKURA LTD., Tokyo (JP)

(72) Inventor: Yuta Hasegawa, Sakura (JP)

(73) Assignee: FUJIKURA LTD., Tokyo (JP)

( * ) Notice: Subject to any disclaimer, the term of this patent is extended or adjusted under 35 U.S.C. 154(b) by 66 days.

(21) Appl. No.: 17/633,004

(22) PCT Filed: Feb. 19, 2021

(86) PCT No.: PCT/JP2021/006396
§ 371 (c)(1),
(2) Date: Feb. 4, 2022

(87) PCT Pub. No.: WO2021/240918
PCT Pub. Date: Dec. 2, 2021

(65) Prior Publication Data

US 2022/0285811 A1 Sep. 8, 2022

(30) Foreign Application Priority Data

May 28, 2020 (JP) ..... 2020-093732

(51) Int. Cl.
*H01P 1/203* (2006.01)
*H01P 7/08* (2006.01)

(52) U.S. Cl.
CPC ..... *H01P 1/20363* (2013.01); *H01P 1/20381* (2013.01); *H01P 7/082* (2013.01)

(58) Field of Classification Search
CPC .. H01P 1/20363; H01P 1/20354; H01P 1/203; H01P 1/20327; H01P 1/20381;
(Continued)

(56) References Cited

U.S. PATENT DOCUMENTS 4,266,206 A 5/1981 Bedard et al.
5,014,024 A 5/1991 Shimizu et al.
(Continued)

FOREIGN PATENT DOCUMENTS

CN 103915667 A 7/2014
CN 106450601 A 2/2017
(Continued)

OTHER PUBLICATIONS

International Preliminary Report on Patentability (Form PCT/IB/373) issued in counterpart International application No. PCT/JP2021/006396 dated Nov. 17, 2022 with Form PCT/ISA/237. (5 pages).
(Continued)

*Primary Examiner* — Stephen E. Jones
(74) *Attorney, Agent, or Firm* — WHDA, LLP

(57) ABSTRACT

Deterioration is reduced in filter characteristics in a type of bandpass filter that is called a strip-line filter or a microstrip filter. A bandpass filter (filter 10) includes a ground conductor layer (12), a plurality of resonators (141 to 146) arranged in a layer spaced from the ground conductor layer (12), a first line (line 151) connected to a first-pole resonator (141) and a second line (line 152) connected to a last-pole resonator (146), wherein a direction in which the first line (line 151) is drawn out from the first-pole resonator (141) and a direction in which the second line (line 152) is drawn out from the last-pole resonator (146) are opposite to each other.

7 Claims, 11 Drawing Sheets

(58) Field of Classification Search
CPC .. H01P 7/082; H01P 7/084; H01P 7/08; H01P 7/088
See application file for complete search history.

(56) References Cited

U.S. PATENT DOCUMENTS

| | | | | |
|---|---|---|---|---|
| 2005/0253671 | A1 | 11/2005 | Hamada et al. | |
| 2008/0055181 | A1* | 3/2008 | Kawaguchi | H01Q 1/52 333/204 |
| 2013/0088309 | A1 | 4/2013 | Baik | |
| 2020/0076031 | A1 | 3/2020 | Nam | |

FOREIGN PATENT DOCUMENTS

| | | | |
|---|---|---|---|
| CN | 107293831 | A | 10/2017 |
| JP | 63-258101 | A | 10/1988 |
| JP | H02-72001 | U | 6/1990 |
| JP | H02-284501 | A | 11/1990 |
| JP | H04-116404 | U | 10/1992 |
| JP | H07-58508 | A | 3/1995 |
| JP | 2000-357903 | A | 12/2000 |
| JP | 2001-358501 | A | 12/2001 |
| JP | 2002-335111 | A | 11/2002 |
| JP | 2005-117433 | A | 4/2005 |
| JP | 2007-195126 | A | 8/2007 |
| JP | 2007-318271 | A | 12/2007 |

OTHER PUBLICATIONS

Hong, Jia-Sheng et al., "Cross-Coupled Microstrip Hairpin-Resonator Filters", IEEE Transaction On Microwave Theory and Techniques, vol. 46, No. 1, 1998, pp. 118-122; Cited in JP Office Action dated Aug. 30, 2022.

Office Action dated Aug. 30, 2022, issued in counterpart JP Application No. 2022-527517, with English translation.

International Search Report dated Apr. 20, 2021, issued in counterpart International Application No. PCT/JP2021/006396, with English Translation. (5 pages).

Written Opinion of the International Searching Authority (Form PCT/ISA/237) dated Apr. 20, 2021, issued in counterpart International Application No. PCT/JP2021/006396. (4 pages).

Hong et al., "Electronics Letters", Nov. 9, 1995, vol. 31, No. 23, pp. 2020. Cited in Specification. (3 pages).

* cited by examiner

BANDPASS FILTER

TECHNICAL FIELD

The present invention relates to a bandpass filter.

BACKGROUND ART

FIG. 1 of Non-Patent Literature 1 illustrates a bandpass filter including: a substrate made of a dielectric; a ground conductor layer provided on a main surface on a lower side of the substrate; and n resonators (in Non-Patent Literature 1, n=6), a first line, and a second line provided on a main surface on an upper side of the substrate.

The n resonators are each made of a long narrow conductor bent into a rectangular shape so that the ends of the long narrow conductor have a gap therebetween. The n resonators are arranged in two rows and n/2 columns. The first line is connected to a first-pole resonator, whereas the second line is connected to a last-pole resonator.

The first line is connected to a part of the long narrow conductor constituting the first-pole resonator which part is near a midpoint of the long narrow conductor, and the second line is connected to a part of the long narrow conductor constituting the last-pole resonator which part is near a midpoint of the long narrow conductor. The first line and the second line function as lines that allow input/output of a high frequency signal with respect to the bandpass filter.

The bandpass filter configured as above is one example of a microstrip filter. On the n resonators, the first line, and the second line of this microstrip filter, another substrate made of a dielectric and another ground conductor layer can be stacked. Consequently, the bandpass filter shown in FIG. 1 is transformed into a strip-line filter.

CITATION LIST

Non-Patent Literatures

Non-Patent Literature 1

J. S. Hong and M. J. Lancaster, Electronics LETTERS, 9 Nov. 1995, Vol. 31, No. 23, p. 2020.

SUMMARY OF INVENTION

Technical Problem

The bandpass filter shown in FIG. 1 employs a configuration wherein an i-th resonator, which is a resonator at an i-th place (i is an integer of not less than 1 and not more than n−1), and an i+1-th resonator, which is a resonator at an i+1-th place, are magnetically coupled to each other and the first-pole resonator and the last-pole resonator are electrostatically coupled to each other. In this case, the first-pole resonator and the last-pole resonator are arranged such that a gap of the first-pole resonator and a gap of the last-pole resonator are close to each other. As described above, the first and second lines are respectively connected to the parts of the long narrow conductors constituting the resonators which parts are near the midpoints of the long narrow conductors. That is, each of the first and second lines is connected to a side opposite to a side including the gap. Therefore, in the bandpass filter shown in FIG. 1, a distance between the first line and the second line can be easily increased.

Meanwhile, depending on the design policy of the bandpass filter, another configuration may be employed wherein a first-pole resonator and a last-pole resonator are magnetically coupled to each other, a second resonator, which is a resonator in a second place, and an n−1-th resonator, which is a resonator in an n−1-th place, are electrostatically coupled to each other. A filter 2010, which is a bandpass filter configured as such, is shown in FIG. 11. FIG. 11 is a perspective view of the filter 2010.

As shown in FIG. 11, the filter 2010 is a strip-line filter including a multilayer substrate 2011, ground conductor layers 2012 and 2013, six resonators 2141 to 2146, and lines 2151 and 2152. The multilayer substrate 2011 is constituted by a substrate 2111 and a substrate 2112, which are two plate-like substrates each made of a dielectric. The ground conductor layers 2012 and 2013 are respectively provided to paired outer layers of the multilayer substrate 2011. The resonators 2141 to 2146 and the lines 2151 and 2152 are provided in an inner layer of the multilayer substrate 2011. The resonator 2141 is the first-pole resonator, and the resonator 2146 is the last-pole resonator. The line 2151 is the first line, and the line 2152 is the second line. The line 2151 is connected to the resonator 2141, and the line 2152 is connected to the resonator 2146.

Also in the filter 2010 configured as above, coupling between the resonators 2141 and 2142 and coupling between the resonators 2145 and 2146 are required to be magnetic. That is, it is required that the resonator 2141 be magnetically coupled to the resonator 2142 and the resonator 2146 and the resonator 2146 be magnetically coupled to the resonator 2141 and the resonator 2145.

In order to satisfy this condition, the resonators 2141 and 2146 are preferably arranged such that one of the four sides of the resonator 2141 which one includes a gap G1 and one of the four sides of the resonator 2146 which one includes a gap G6 are most distant from each other. This inevitably shortens a distance between the lines 2151 and 2152.

Incidentally, for the purpose of coupling with a high frequency signal, a first end out of the ends of the line 2151 which first end is not connected to the resonator 2141 and a second end out of the ends of the line 2152 which second end is not connected to the resonator 2146 may respectively have the following configurations. Specifically, the ground conductor layer 2012 has a first anti-pad surrounding an area overlapping the first end in a plan view and a second anti-pad surrounding an area overlapping the second end in a plan view. The area surrounded by the first anti-pad is a first land, and the area surrounded by the second anti-pad is a second land. In addition, the first end and the first land are connected to each other through a first via provided in the substrate 2111, and the second end and the second land are connected to each other through a second via provided in the substrate 2111.

In the configuration in which the filter 2010 includes the first land, the second land, the first via, and the second via, coupling between the first land and the first via and coupling between the second land and the second via are likely to occur, and therefore the filter characteristics are often deteriorated.

The present invention was made in view of the above-described problem, and has an object to reduce deterioration in filter characteristics in a type of bandpass filter that is called a strip-line filter or a microstrip filter.

Solution to Problem

In order to attain the above object, a bandpass filter in accordance with an aspect of the present invention includes: at least one ground conductor layer; a plurality of resonators arranged in a layer spaced from the at least one ground conductor layer, each of the plurality of resonators being made of a long narrow conductor; a first line that is a long narrow conductor connected to a first-pole resonator, which is one of the plurality of resonators; and a second line that is a long narrow conductor connected to a last-pole resonator, which is another one of the plurality of resonators, a direction in which the first line is drawn out from the first-pole resonator and a direction in which the second line is drawn out from the last-pole resonator being opposite to each other.

A bandpass filter configured as above is a type of bandpass filter that is called a strip-line filter or a microstrip filter.

Advantageous Effects of Invention

In accordance with an aspect of the present invention, it is possible to reduce deterioration in filter characteristics in a type of bandpass filter that is called a strip-line filter or a microstrip filter.

Figure 6:
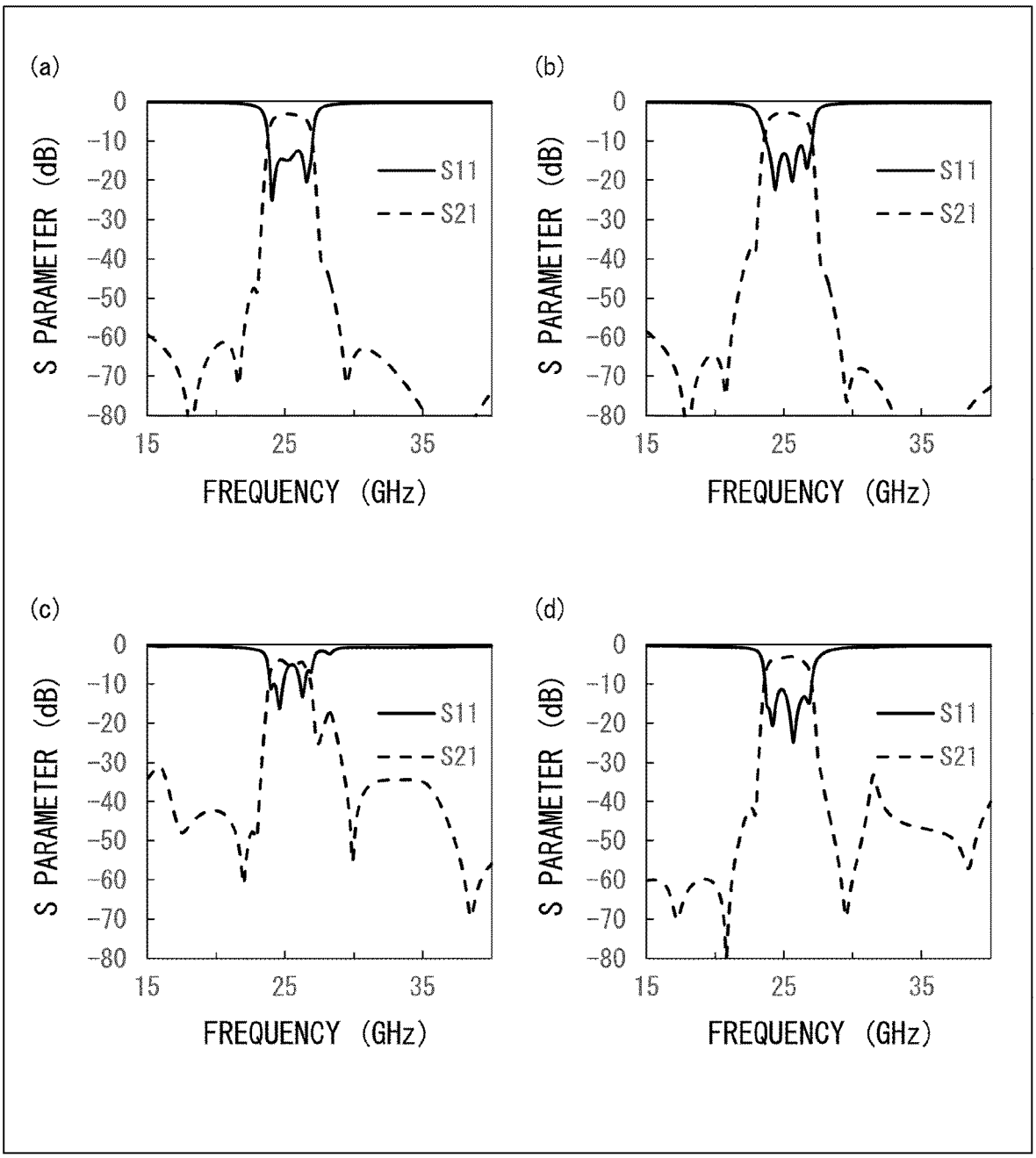

(a) to (d) of FIG. 6 respectively show graphs indicating S parameters of Comparative Example 1, Example 1, Comparative Example 2, and Example 2.

Figure 1:
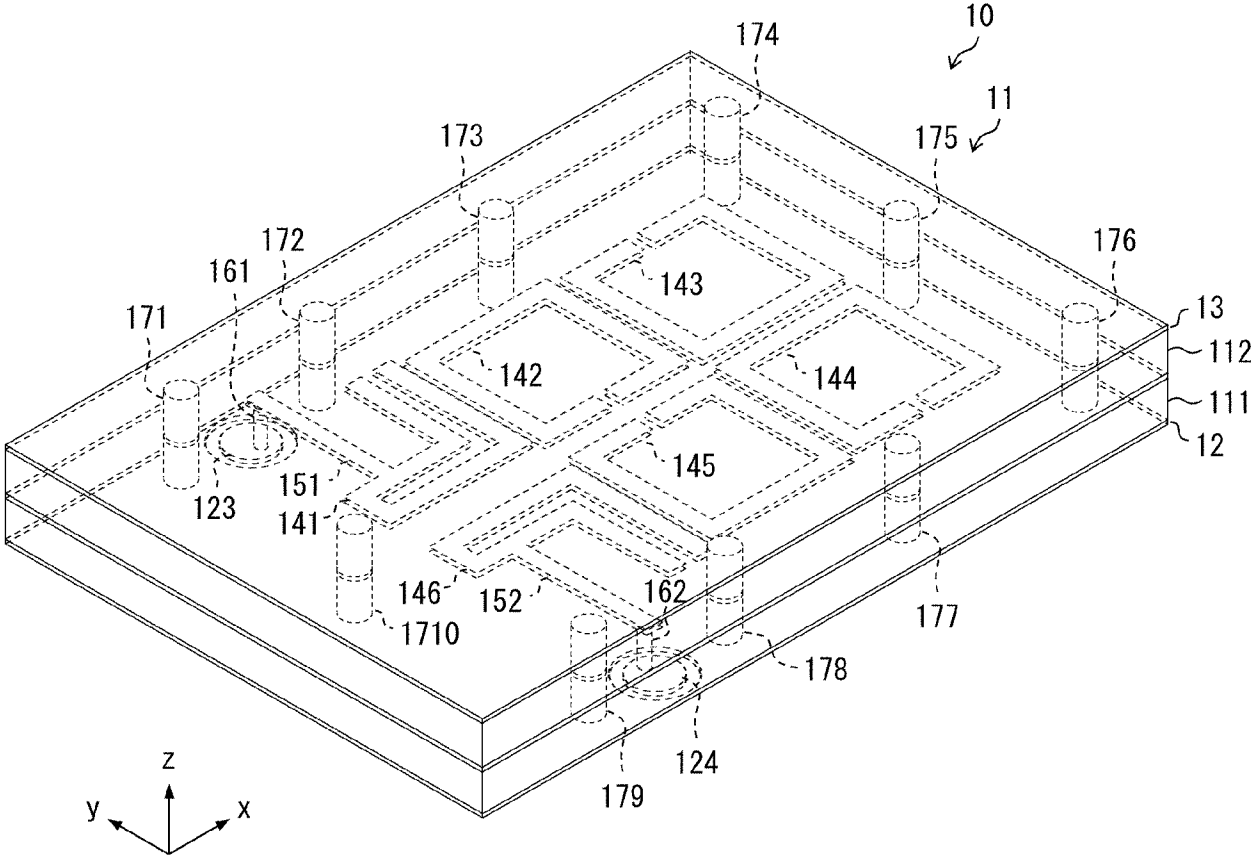
FIG. 1 is a perspective view of a filter in accordance with Embodiment 1 of the present invention.
Figure 7:
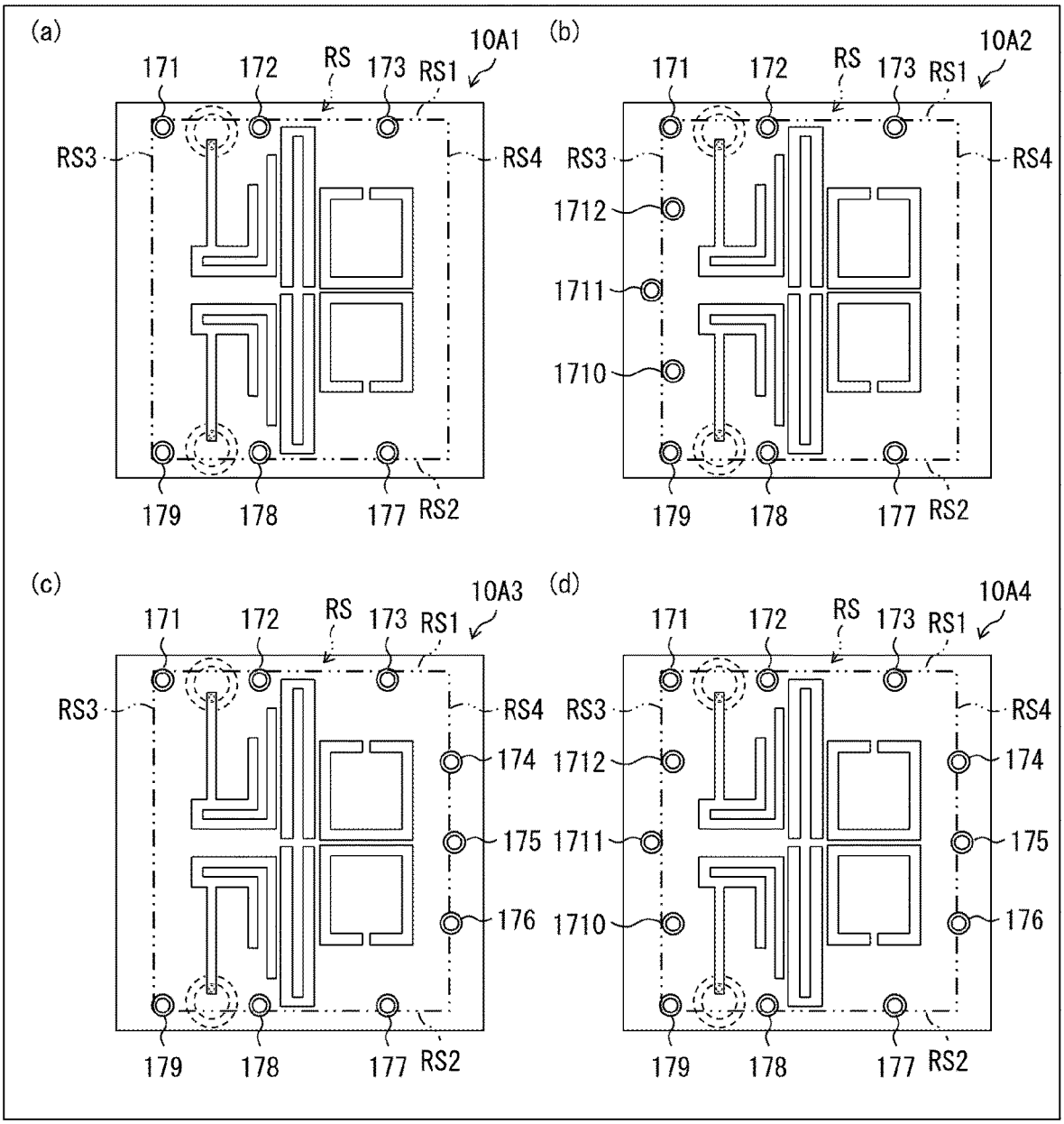

(a) to (d) of FIG. 7 are plan views of pluralities of resonators included in Variations 2, 3, 4, and 5 of the filter shown in FIG. 1.

Figure 8:
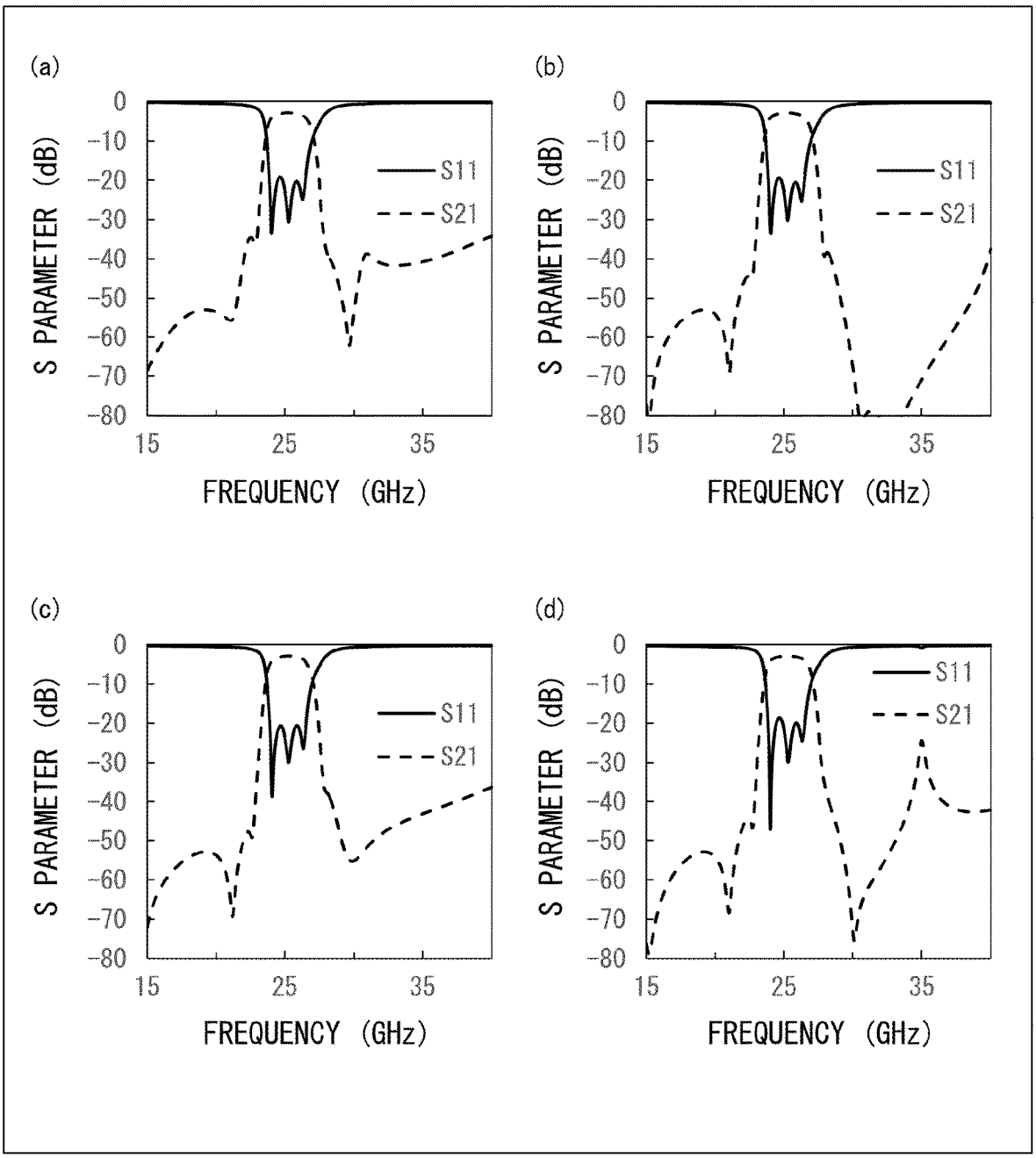

(a) to (d) of FIG. 8 respectively show graphs indicating S parameters of Variations 2, 3, 4, and 5.

Figure 9:
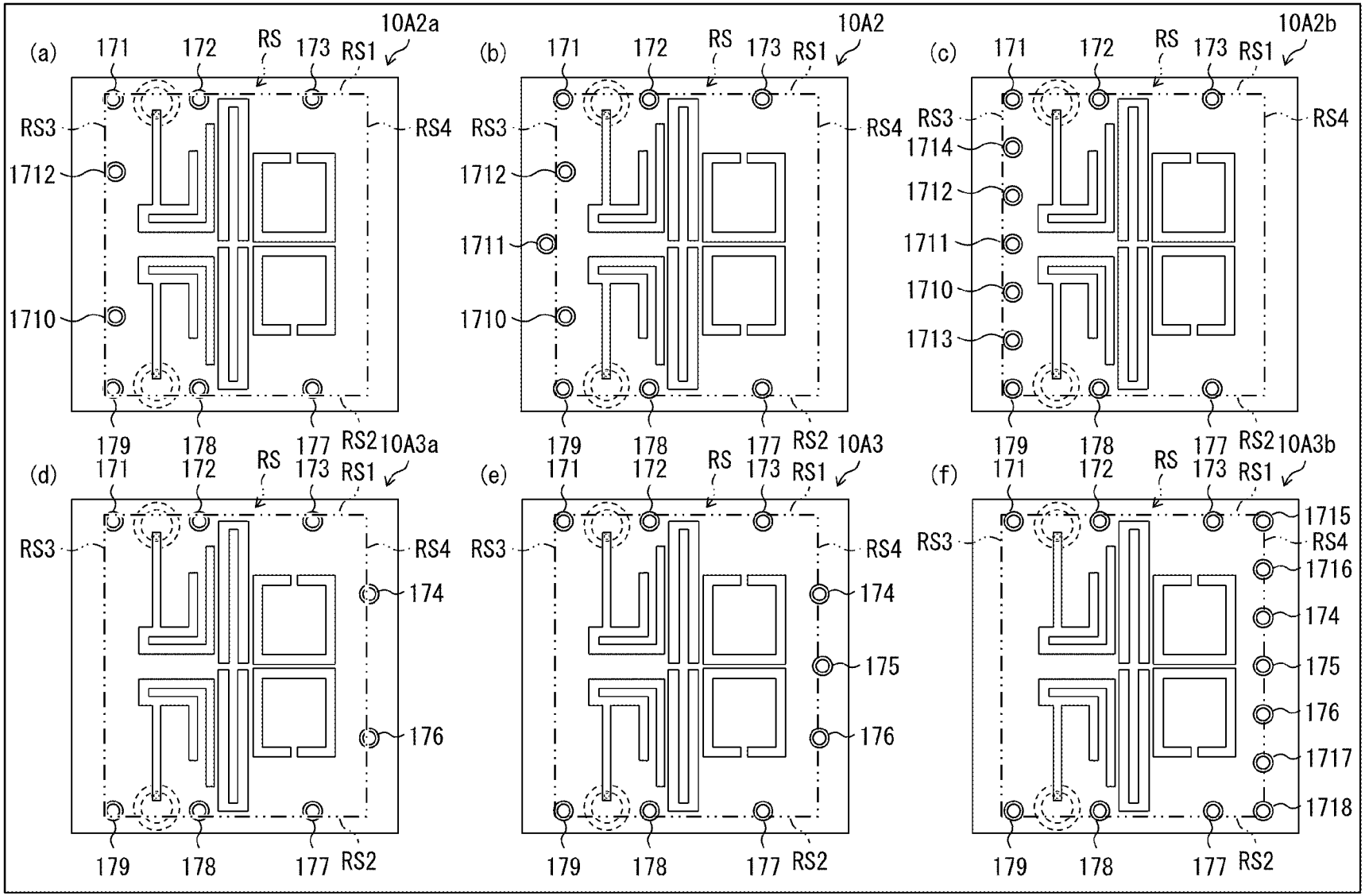

(b) of FIG. 9 is a plan view of a plurality of resonators included in Variation 3 shown in (b) of FIG. 7. Each of (a) and (c) of FIG. 9 is a plan view of a plurality of resonators included in a variation of Variation 3. (e) of FIG. 9 is a plan view of a plurality of resonators included in Variation 4 shown in (c) of FIG. 7. Each of (d) and (f) of FIG. 9 is a plan view of a plurality of resonators included in a variation of Variation 4.

Figure 10:
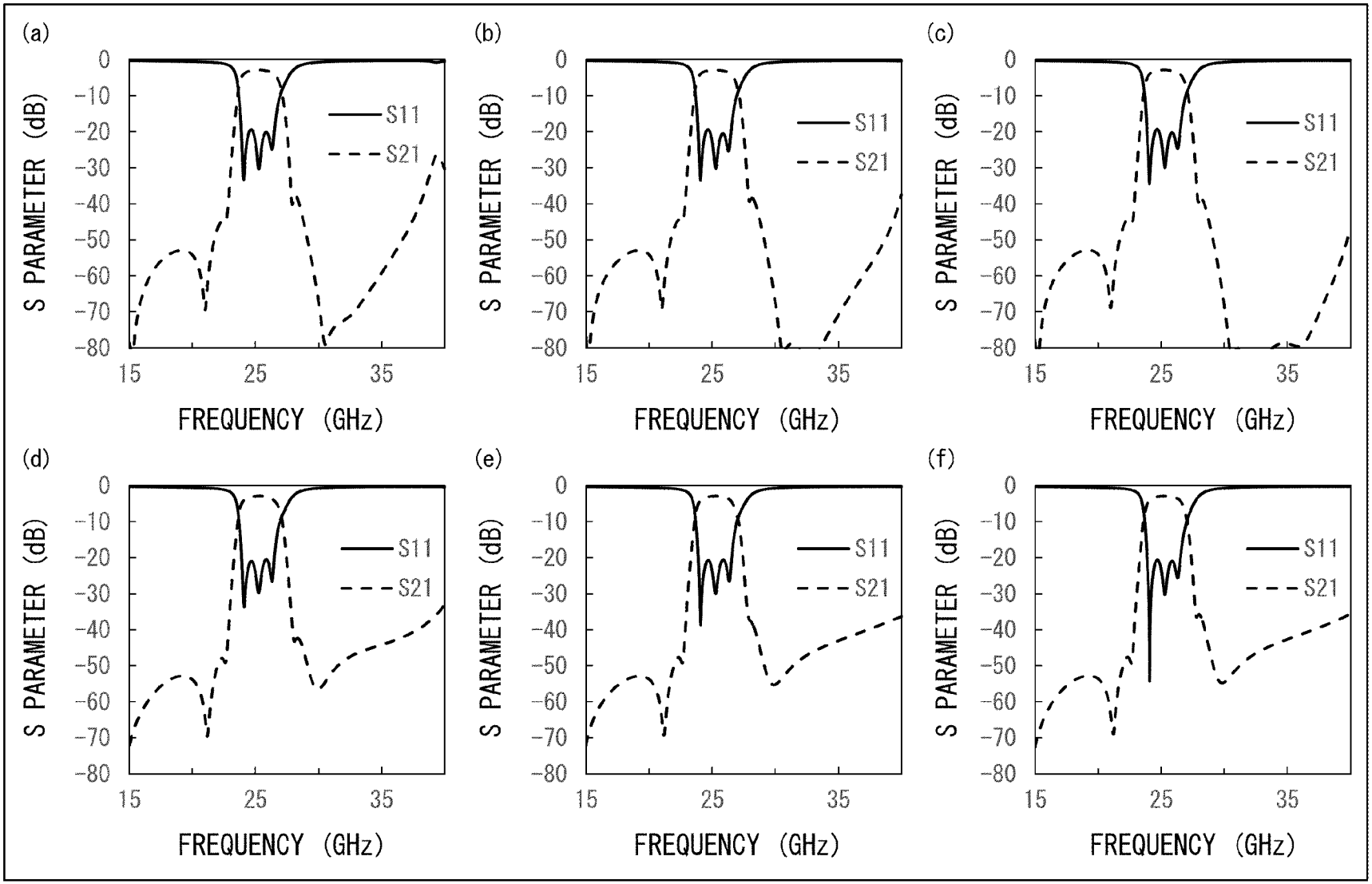

(a) to (f) of FIG. 10 respectively show graphs indicating S parameters of the filters shown in (a) to (f) of FIG. 9.

Figure 11:
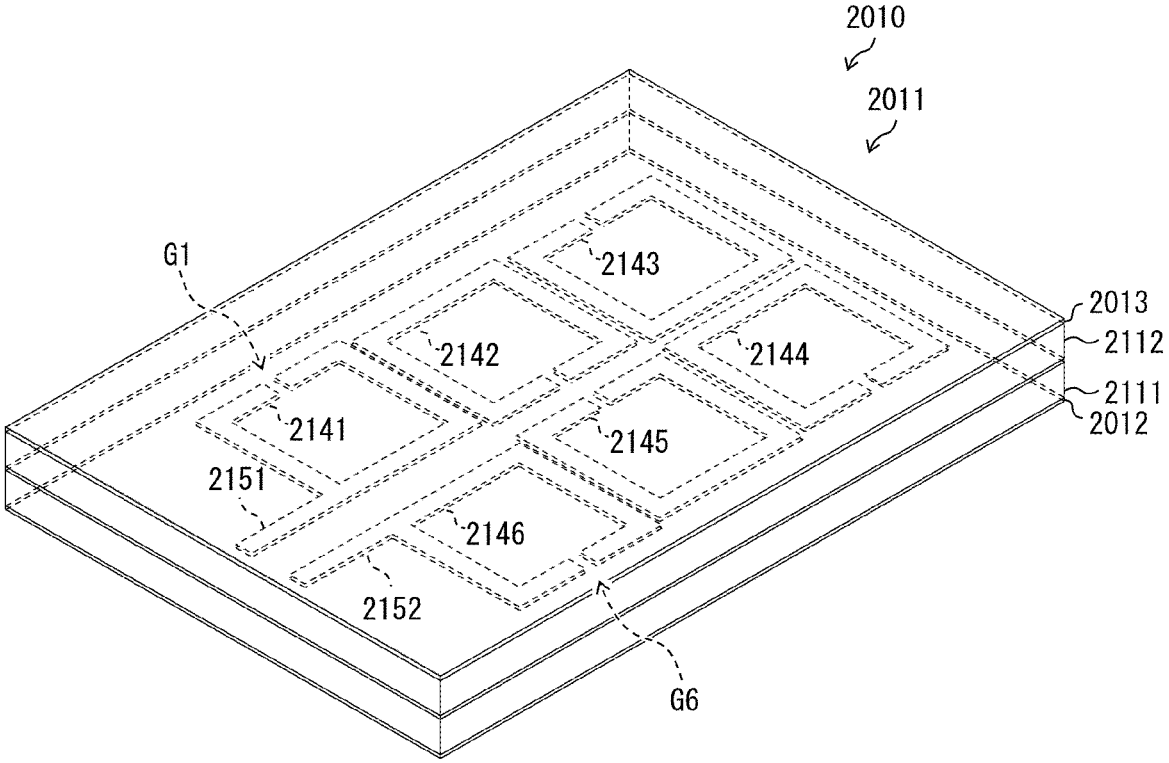

FIG. 11 is a perspective view of a conventional bandpass filter.

DESCRIPTION OF EMBODIMENTS

Embodiment 1

Figure 2:
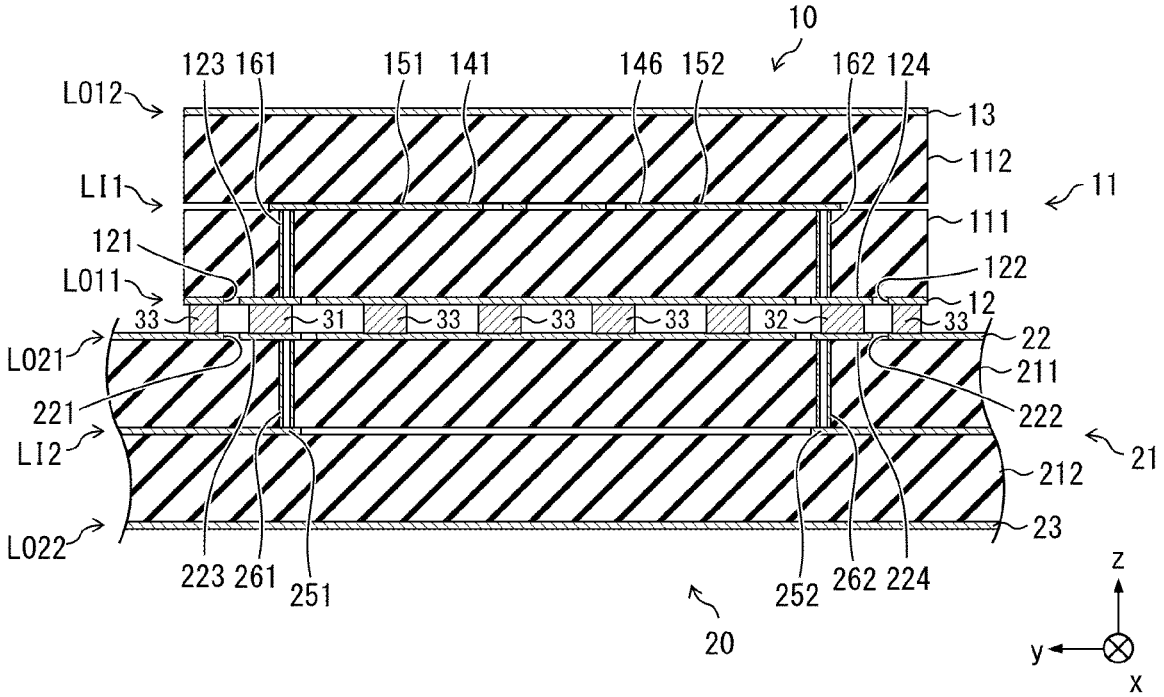
FIG. 2 is a cross-sectional view of the filter shown in FIG. 1.
Figure 3:
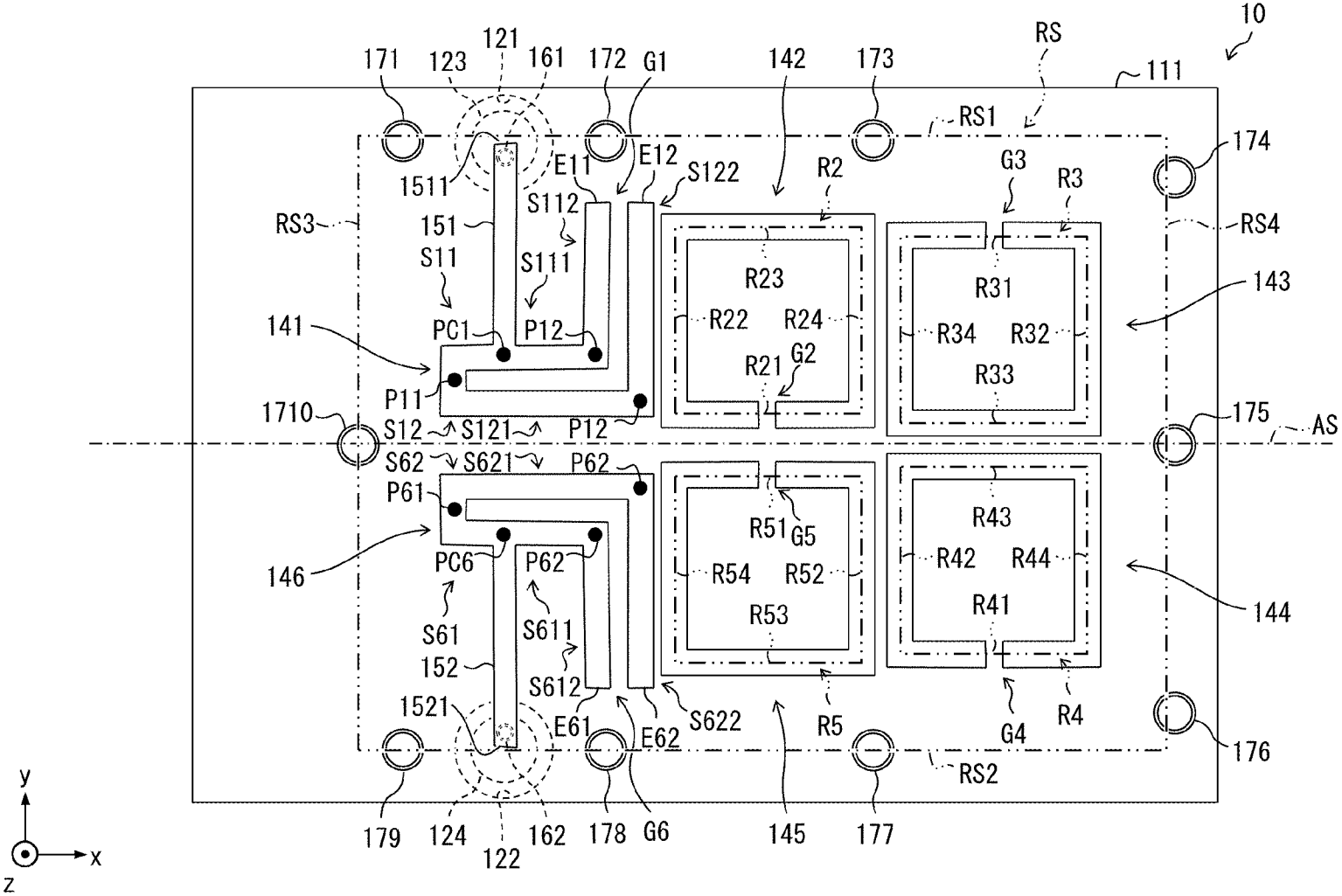
FIG. 3 is a plan view of resonators and lines included in the filter shown in FIG. 1.

With reference to FIGS. 1 to 3, the following description will discuss a filter 10, which is a bandpass filter in accordance with Embodiment 1 of the present invention. The following description will also discuss a mounting substrate 20, on which the filter 10 is to be mounted, with reference to FIG. 2. FIG. 1 is a perspective view of the filter 10. FIG. 2 is a cross-sectional view of the filter 10. Note that FIG. 2 illustrates a cross section of the filter 10 taken along central axes of lines 151 and 152. The filter 10 shown in FIG. 2 is in a state where the filter 10 is mounted on the mounting substrate 20. FIG. 3 is a plan view of resonators 141 to 146 and the lines 151 and 152 included in the filter 10. Note that, in FIG. 3, a substrate 112 and a ground conductor layer 13, each of which is included in the filter 10, are not illustrated.

Orthogonal coordinate systems in FIGS. 1 to 3 are set such that main surfaces of a substrate 111 and the substrate 112 are in parallel with an x-y plane and a symmetric axis AS (see FIG. 3) of the filter 10 is in parallel with an x-axis. A direction from the resonator 141 toward the resonator 143 is defined as an x-axis positive direction, a direction from the resonator 146 toward the resonator 141 is defined as a y-axis positive direction, and a direction from the substrate 111 toward the substrate 112 is defined as a z-axis positive direction.

As shown in FIGS. 1 and 2, the filter 10 includes a multilayer substrate 11, a ground conductor layer 12, the ground conductor layer 13, the resonators 141 to 146, the lines 151 and 152, vias 161 and 162, and through vias 171 to 179 and 1710.

<Multilayer Substrate>

The multilayer substrate 11 includes the substrates 111 and 112 and an adhesive layer. In FIGS. 1 and 2, the adhesive layer is not illustrated.

The substrates 111 and 112 are two plate-like members each made of a dielectric. In the state illustrated in FIG. 1, the substrate 112 is disposed above (i.e., on a z-axis positive direction side of) the substrate 111. Hereinafter, one of the paired main surfaces of the substrate 111 which one is farther from the substrate 112 will be referred to as an outer layer LO11, one of the paired main surfaces of the substrate 112 which one is farther from the substrate 111 will be referred to as an outer layer LO12, and a layer between the substrates 111 and 112 will be referred to as an inner layer LI1.

In Embodiment 1, the substrates 111 and 112 are each made of a liquid crystal polymer resin. Note that the dielectric constituting the substrates 111 and 112 is not limited to the liquid crystal polymer resin, and may alternatively be a glass epoxy resin, an epoxy composition, a polyimide resin, or the like. In Embodiment 1, each of the substrates 111 and 112 has a rectangular shape in a plan view. Note that the shape of each of the substrates 111 and 112 is not limited to the rectangular shape, and can be selected as appropriate.

The adhesive layer is provided to the inner layer LI1, and bonds the substrates 111 and 112 to each other. An adhesive constituting the adhesive layer is not limited to any particular type, and may be selected as appropriate from among existing adhesives.

<Ground Conductor Layer>

The ground conductor layer 12 is constituted by a conductor film provided to the outer layer LO11. The ground conductor layer 13 is constituted by a conductor film provided to the outer layer LO12. The ground conductor layers 12 and 13 are an example of the paired ground conductor layers facing each other. Together with the later-described resonators 141 to 146 and lines 151 and 152, the ground conductor layers 12 and 13 constitute a strip line.

In one aspect of the present invention, out of the ground conductor layers 12 and 13, the ground conductor layer 13 can be omitted. In a case where the ground conductor layer 13 is omitted, the substrate 112 can also be omitted. In a case where the ground conductor layer 13 is omitted, the ground conductor layer 12 constitutes a microstrip line, together with the later-described resonators 141 to 146 and lines 151 and 152.

In Embodiment 1, the ground conductor layers 12 and 13 are each made of copper. Note that the conductor constituting the ground conductor layers 12 and 13 is not limited to copper, and may alternatively be gold, aluminum, or the like.

As shown in FIGS. 2 and 3, the ground conductor layer 12 has anti-pads 121 and 122. In a plan view, the anti-pad 121 is formed so as to surround an area overlapping, out of the ends of the line 151, an end 1511 not connected to the resonator 141 (see FIG. 3). In a plan view, the anti-pad 122 is formed so as to surround an area overlapping, out of the ends of the second line 152, an end 1521 not connected to the resonator 146 (see FIG. 3). The end 1511 is an example of the first end, and the end 1512 is an example of the second end.

Hereinafter, an area surrounded by the anti-pad 121 will be referred to as a land 123, and an area surrounded by the anti-pad 122 will be referred to as a land 124. The anti-pad 121 is an example of the first anti-pad, and the anti-pad 122 is an example of the second anti-pad. The land 123 is an example of the first land, and the land 124 is an example of the second land.

<Resonator>

The resonators 141 to 146, which are six resonators, are an example of the plurality of resonators arranged in the layer spaced from the ground conductor layer 12. The resonators 141 to 146 are arranged so as to be spaced from each other so that adjacent ones of the resonators are spaced from each other at a given interval. In one aspect of the present invention, the number of resonators (poles) is not limited to six, but can be selected as appropriated so that desired reflection characteristics and desired transmission characteristics can be attained. It should be noted that the number of resonators is preferably an even number.

In Embodiment 1, the filter 10 is a strip-line filter. Therefore, the resonators 141 to 146 are provided so as to be spaced from the ground conductor layers 12 and 13 and to be interposed between the ground conductor layers 12 and 13. In Embodiment 1, the resonators 141 to 146 are provided in the inner layer LI1.

As shown in FIGS. 1 to 3, the resonators 141 to 146 are each made of a long narrow conductor. As shown in FIG. 3, the resonators 141 to 146, provided in the inner layer LI, are each made of a long narrow conductor bent so that the paired ends thereof form a corresponding one of the gaps G1 to G6. In Embodiment 1, the resonators 141 to 146 are each made of copper. Note that the long narrow conductors constituting the resonators 141 to 146 are not limited to copper, and may alternatively be gold, aluminum, or the like.

The resonators 141 to 146 are arranged in two rows and three columns. The resonator 141 is an example of the first resonator, the resonator 142 is an example of the second resonator, and the resonator 143 is an example of the third resonator. The resonator 141 is disposed on a first row and a first column, the resonator 142 is disposed on the first row and a second column, and the resonator 143 is disposed on the first row and a third column. The resonator 144 is an example of the fourth resonator, the resonator 145 is an example of the fifth resonator, and the resonator 146 is an example of the sixth resonator. The resonator 144 is disposed on a second row and the third column, the resonator 145 is disposed on the second row and the second column, and the resonator 146 is disposed on the second row and the first column.

(First-Pole Resonator and Last-Pole Resonator)

The resonator 141 is connected to the later-described line 151, and the resonator 146 is connected to the later-described line 152. Thus, the resonator 141 is an example of the first-pole resonator, and the resonator 146 is an example of the last-pole resonator.

A first-pole long narrow conductor, which constitutes the resonator 141, is bent at a bent point P11, which is near a midpoint of the first-pole long narrow conductor, such that a section S11 including an end E11, which is one end of the first-pole long narrow conductor, extends along (i.e., in parallel with) a section S12 including an end E12, which is the other end of the first-pole long narrow conductor. The bent point P11 is an example of the first bent point. The section S11 is an example of the first section, and the section S12 is an example of the second section. Note that, of the sections S11 and S12, one closer to the resonator 146 will be referred to as the section S12, and the other farther from the resonator 146 will be referred to as the section S11.

In addition, the first-pole long narrow conductor is bent such that each of the sections S11 and S12 is bent at a respective bent point P12, which is near a midpoint of a corresponding one of the sections S11 and S12, so that a corresponding one of sub sections S111 and S121 including their respective bent points P11 is orthogonal to a corresponding one of sub sections S112 and S122 respectively including the ends E11 and E12. Each of the sub sections S111 and S121 is an example of the first sub section, and each of the sub sections S112 and S122 is an example of the second sub section.

Similarly, a last-pole long narrow conductor, which constitutes the resonator 146, is bent at a bent point P61, which is near a midpoint of the last-pole long narrow conductor, such that a section S61 including an end E61, which is one end of the last-pole long narrow conductor, extends along (i.e., in parallel with) a section S62 including an end E62, which is the other end of the last-pole long narrow conductor. The bent point P61 is an example of the second bent point. The section S61 is an example of the first section, and the section S62 is an example of the second section. Note that, of the sections S61 and S62, one closer to the resonator 141 will be referred to as the section S62, and the other farther from the resonator 141 will be referred to as the section S61.

In addition, the last-pole long narrow conductor is bent such that each of the sections S61 and S62 is bent at a respective bent point P62, which is near a midpoint of a corresponding one of the sections S61 and S62, so that a corresponding one of sub sections S611 and S621 including their respective bent points P61 is orthogonal to a corresponding one of sub sections S612 and S622 respectively including the ends E61 and E62. Each of the sub sections S611 and S621 is an example of the first sub section, and each of the sub sections S612 and S622 is an example of the second sub section.

The resonators 141 and 146 are arranged such that the first sub sections extend in parallel with each other and the second sub sections extend in directions opposite to each other. That is, the resonators 141 and 146 are arranged such that (i) the sub sections S111 and S121 are in parallel with the sub sections S611 and S621 and (ii) a direction in which the sub sections S112 and S122 extend is opposite to a direction in which the sub sections S612 and S622 extend. The direction in which the sub sections S112 and S122 extend means a direction from the bent point P12 toward the ends E11 and E12, and is the y-axis positive direction in Embodiment 1. Similarly, the direction in which the sub sections S612 and S622 extend means a direction from the bent point P62 toward the ends E61 and E62, and is the y-axis negative direction in Embodiment 1.

The later-described line 151 is connected to the resonator 141 at a connection point PC1 in the first-pole long narrow conductor constituting the resonator 141, the connection point PC1 being near the bent point P11 of the sub section S111. The later-described line 152 is connected to the resonator 146 at a connection point PC6 in the last-pole long narrow conductor constituting the resonator 146, the connection point PC6 being near the bent point P61 of the sub section S611.

(Other Resonators)

As shown in FIG. 3, the resonators 142 to 145, which are respectively the second to fifth resonators, are formed by bending, within the inner layer LI1, long narrow conductors constituting the respective resonators. More specifically, each of the resonators 142 to 145 is formed by bending a respective long narrow conductor constituting the resonator so that the paired ends of the long narrow conductor form a corresponding one of gaps G2 to G5 and the long narrow conductor forms a quadrangular shape. In Embodiment 1, each of the resonators 142 to 145 has a square shape. FIG. 3 shows, by double-dashed lines, squares R2 to R5 respectively corresponding to the center axes of the long narrow conductors constituting the resonators 142 to 145. Note that the shape of each of the resonators 142 to 145 is not limited to the square shape, but may alternatively be a rectangular shape. Note also that the shapes of the resonators 142 to 145 may be the same or different from each other.

In the resonator 142, out of the four sides of the square R2, one side including the gap G2 will be referred to as a side R21, and the other three sides will be referred to as sides R22, R23, and R24, respectively, in this order from the side R21 in a clockwise direction.

Similarly to the resonator 142, each of the resonators 143 to 145 has a side including a corresponding one of the gap G3, G4, and G5, and such a side will be referred to as a side R31, R41, or R51. In each of the resonators 143 to 145, the other three sides will be respectively referred to as (1) a side R32, R42, or R52, (2) a side R33, R43, or R53, and (3) a side R34, R44, or R54 in this order from the side R31, R41, or R51 in a clockwise direction.

The resonator 142 is disposed such that the gap G2 faces a direction closer to the resonator 145 (i.e., the y-axis negative direction). The resonator 143 is disposed such that the gap G3 faces a direction farther from the resonator 144 (i.e., the y-axis positive direction). The resonator 144 is disposed such that the gap G4 faces a direction farther from the resonator 143 (i.e., the y-axis negative direction). The resonator 145 is disposed such that the gap G5 faces a direction closer to the resonator 142 (i.e., the y-axis positive direction).

In other words, the resonators 141 to 146 are arranged such that one side which is a linear section of an i-th resonator and one side which is a linear section of an i+1-th resonator are close to each other and the gap G2 of the resonator 142 and the gap G5 of the resonator 145 are close to each other, where i is an integer of not less than 1 and not more than 5. Note that the resonator 141 is disposed such that the sub section S122 is close to the side R22 of the resonator 142 and the resonator 146 is disposed such that the sub section S622 is close to the side R54 of the resonator 145.

(Coupling Between Adjacent Resonators)

In the filter 10 including the resonators 141 to 146 arranged in the above-described manner, (1) coupling between the resonators 141 and 142, (2) coupling between the resonators 142 and 143, (3) coupling between the resonators 143 and 144, (4) coupling between the resonators 144 and 145, (5) coupling between the resonators 145 and 146, and (6) coupling between the resonators 141 and 146 are mostly magnetic, whereas (7) coupling between the resonators 142 and 145 is mostly electrostatic.

In order to achieve a group delay compensation filter or an equal group delay filter, resonators are often arranged so that a first-pole resonator and a last-pole resonator are electrostatically coupled to each other, like the bandpass filter disclosed in FIG. 1 of Non-Patent Literature 1. Meanwhile, in order to achieve an elliptic function bandpass filter that includes six resonators and that is configured to select a sharp band to be used, coupling between a second resonator and a fifth resonator is often made electrostatic and coupling between the other resonators is often made magnetic. In a case where an aspect of the present invention is adopted to achieve an elliptic function bandpass filter including six resonators, coupling that can occur between the later-described paired input/output ports can be reduced and accordingly its effect on the filter characteristics can be reduced, as compared to that in the configuration of the bandpass filter disclosed in FIG. 1 of Non-Patent Literature 1 or the like.

<Line>

The lines 151 and 152 are provided in a layer in which the resonators 141 to 146 are provided, i.e., in the inner layer LI1. Each of the lines 151 and 152 is constituted by a long narrow conductor having a linear shape. The lines 151 and 152 and the resonators 141 to 146 are made of a conductor of the same type. Thus, in Embodiment 1, the lines 151 and 152 are each made of copper. Note that the conductor of which the lines 151 and 152 are made is not limited to copper, and may alternatively be gold, aluminum, or the like.

The line 151 is an example of the first line, and the line 152 is an example of the second line. The line 151 has one end connected to the resonator 141 at the connection point PC1, and is drawn out from the connection point PC1 in the y-axis positive direction. The line 152 has one end connected to the resonator 146 at the connection point PC6, and is drawn out from the connection point PC6 in the y-axis negative direction. Thus, the direction in which the line 151 is drawn out and the direction in which the line 152 is drawn out are in parallel with each other and are opposite to each other.

<Via>

The vias 161 and 162, which are examples of the first via and the second via, are tubular members each made of a conductor. The vias 161 and 162 are provided in the substrate 111, which is one of the two substrates 111 and 112 constituting the multilayer substrate 11. Alternatively, the vias 161 and 162 may be columnar members each made of a conductor.

In a plan view, the via 161 is provided in an area where the land 123 provided in the ground conductor layer 12 and the end 1511, which is the other end of the line 151, overlap each other. The via 161 allows the land 123 and the end 1511 to be short-circuited to each other. In a plan view, the via 162 is provided in an area where the land 124 provided in the ground conductor layer 12 and the end 1521, which is the other end of the line 152, overlap each other. The via 162 allows the land 124 and the end 1521 to be short-circuited to each other.

The land 123 and the via 161 function as one of the pairs of input-output ports in the filter 10. Similarly, the land 124 and the via 162 function as one of the pairs of input-output ports in the filter 10.

<Through Via>

The ten through vias 171 to 179 and 1710 are tubular members each made of a conductor, and are provided in the multilayer substrate 11 so as to penetrate through the multilayer substrate 11. Alternatively, the through vias 171 to 179 and 1710 may be columnar members each made of a conductor. Each of the through vias 171 to 179 and 1710 allows the ground conductor layer 12 and the ground conductor layer 13 to be short-circuited to each other.

As shown in FIG. 3, when the substrate 111 is viewed from a normal direction of the substrate 111, among the four sides of a rectangle RS surrounding the resonators 141 to 146, one side close to the end 1511 of the line 151 will be referred to as a side RS1 and another side close to the end 1521 of the line 152 will be referred to as a side RS2. Among the two sides other than the sides RS1 and RS2, one side closer to the lines 151 and 152 (on the x-axis negative direction side) will be referred to as a side RS3, and the other side farther from the lines 151 and 152 will be referred to as a side RS4. The side RS1 is an example of the first side, the side RS2 is an example of the second side, and the side RS3 is an example of the third side.

In Embodiment 1, when the substrate 111 is viewed from a normal direction of the substrate 111, the through vias 171 to 179 and 1710 are provided along the sides RS1 to RS4, which are the four sides of the rectangle RS. Note that the through vias may be provided at least at a location in the side RS1 which location is near the end 1511 and at a location in the side RS2 which location is near the end 1521, and are preferably provided to three sides including the sides RS1 and RS2. There may be a case where the through vias are provided to three side of the sides RS1 to RS4, which are the four sides of the rectangle RS. In this case, the three sides are preferably the sides RS1, RS2, and RS3. Variations of the arrangement of the through vias will be described with reference to FIGS. 7 to 10.

<Symmetry in Filter>

As shown in FIG. 3, in a plan view, the resonators 141 to 146 and the lines 151 and 152 are arranged so as to have line symmetry with respect to a symmetric axis AS. The symmetric axis AS is an axis that is in parallel with a direction (i.e., the x-axis direction) orthogonal to the direction in which the lines 151 and 152 extend (i.e., the y-axis direction) and that is located in the middle between the resonators 141 and 146.

<Mounting Substrate>

As described above, the filter 10 shown in FIG. 2 is in a state where the filter 10 is mounted on the mounting substrate 20. The description here will discuss the mounting substrate 20 with reference to FIG. 2. The mounting substrate 20 includes a multilayer substrate 21, a ground conductor layer 22, and a ground conductor layer 23.

The multilayer substrate 21 includes substrates 211 and 212 and an adhesive layer. In FIG. 2, the adhesive layer is not illustrated.

(Multilayer Substrate)

The substrates 211 and 212 are two plate-like members each made of a dielectric. In the state shown in FIG. 2, the substrate 211 is a substrate closer to the filter 10, and the substrate 212 is disposed below (i.e., on the z-axis negative direction side of) the substrate 211. Hereinafter, one of the paired main surfaces of the substrate 211 which one is farther from the substrate 212 will be referred to as an outer layer LO21, one of the paired main surfaces of the substrate 212 which one is farther from the substrate 211 will be referred to as an outer layer LO22, and a layer between the substrates 211 and 212 will be referred to as an inner layer LI2. The adhesive layer is provided to the inner layer LI2, and bonds the substrates 211 and 212 to each other.

<Ground Conductor Layer>

The ground conductor layer 22 is constituted by a conductor film provided to the outer layer LO21. The ground conductor layer 23 is constituted by a conductor film provided to the outer layer LO22. The ground conductor layers 22 and 23 constitute a strip line, together with the later-described lines 251 and 252.

As shown in FIG. 2, the ground conductor layer 22 has anti-pads 221 and 222. Hereinafter, an area surrounded by the anti-pad 221 will be referred to as a land 223, and an area surrounded by the anti-pad 222 will be referred to as a land 224. In Embodiment 1, a center-to-center distance between the lands 223 and 224 is equal to a center-to-center distance between the lands 123 and 124.

(Line)

The lines 251 and 252 are linear long narrow conductors provided in the inner layer LI2. In a plan view, the line 251 has one end overlapping the land 223. In a plan view, the line 252 has one end overlapping the land 224. As described above, the lines 251 and 252 constitute the strip line, together with the ground conductor layers 22 and 23.

(Via)

The vias 261 and 262 are tubular members each made of a conductor. The vias 261 and 262 are provided in the substrate 211, which is one of the two substrates 211 and 212 constituting the multilayer substrate 21. Alternatively, the vias 261 and 262 may be columnar members each made of a conductor.

In a plan view, the via 261 is provided in an area where the land 223, provided in the ground conductor layer 22, and the one end of the line 251 overlap each other. The via 261 allows the land 223 and the one end of the line 251 to be short-circuited to each other. In a plan view, the via 262 is provided in an area where the land 224, provided in the ground conductor layer 22, and the one end of the line 252 overlap each other. The via 262 allows the land 224 and the one end of the line 252 to be short-circuited to each other.

The land 223 and the via 261 function as one of the pairs of input-output ports in the mounting substrate 20. Similarly, the land 224 and the via 262 function as one of the pairs of input-output ports in the mounting substrate 20.

(Solder)

In Embodiment 1, the filter 10 is mounted on the mounting substrate 20 via solders 31, 32, and 33.

The solder 31 allows electrical connection between the lands 123 and 223, and fixes the filter 10 to the mounting substrate 20. The solder 32 allows electrical connection between the lands 124 and 224, and fixes the filter 10 to the mounting substrate 20. The plurality of solders 33 allow the ground conductor layer 12 and the ground conductor layer 22 to be short-circuited to each other, and fix the filter 10 to the mounting substrate 20.

As described above, the filter 10 can be easily mounted on the mounting substrate 20 with a small loss.

(Variation 1)

Figure 4:
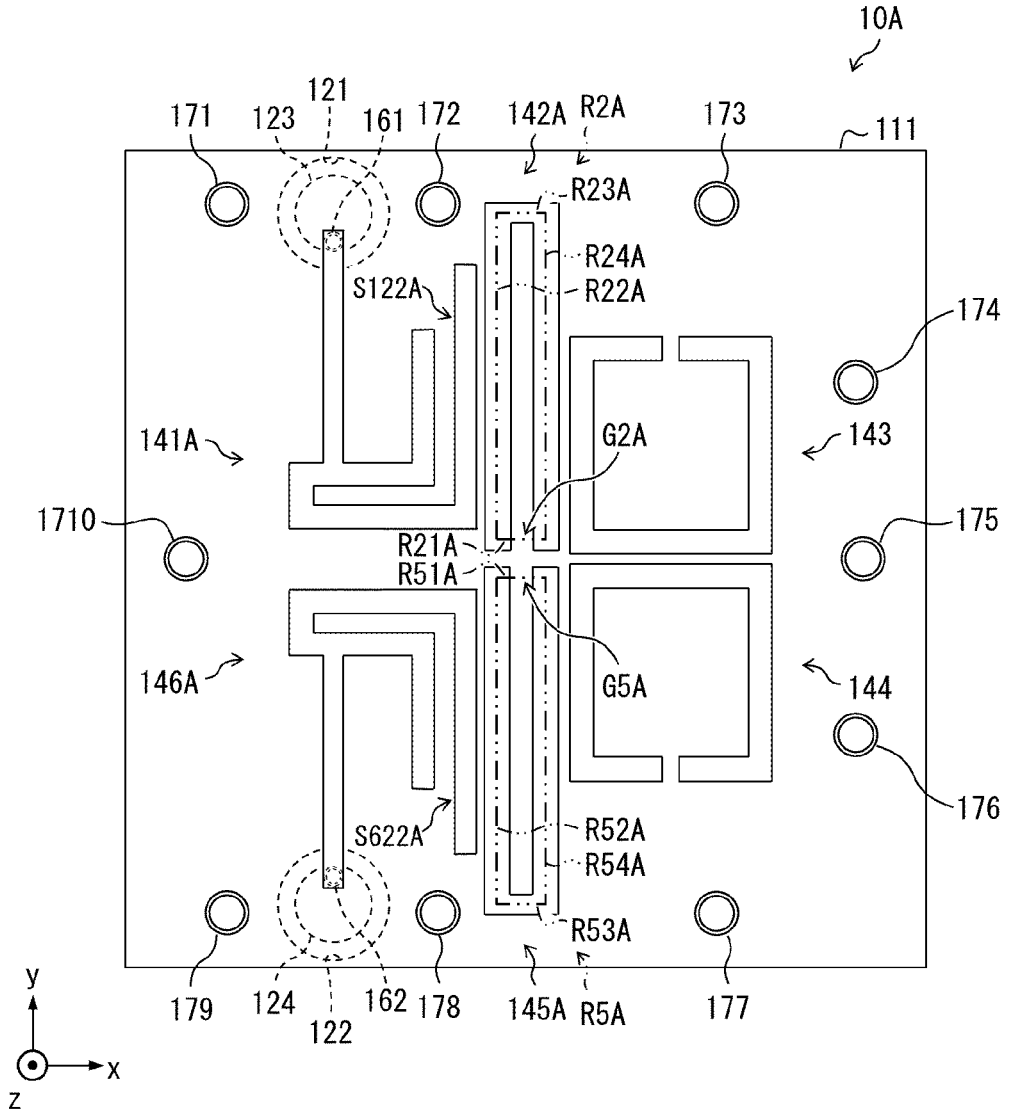
FIG. 4 is a plan view of a plurality of resonators included in Variation 1 of the filter shown in FIG. 1.

With reference to FIG. 4, the following description will discuss a filter 10A, which is Variation 1 of the filter 10 shown in FIGS. 1 to 3. FIG. 4 is a plan view of six resonators included in the filter 10A, specifically, resonators 141A, 142A, 143, 144, 145A, and 146A. Note that, in FIG. 4, a substrate 112 and a ground conductor layer 13, each of which is included in the filter 10A, are not illustrated.

The filter 10A can be obtained by replacing, in the filter 10 adopted as a base, the resonators 141, 142, 145, and 146 with resonators 141A, 142A, 145A, and 146A. Therefore, the description in Variation 1 will deal with only the resonators 141A, 142A, 145A, and 146A. Among the elements of the filter 10A, elements identical to those in the filter 10 are given the same reference signs, and explanations thereof are omitted.

Similarly to the resonators 142 and 145 in the filter 10, each of the resonators 142A and 145A is formed by bending a respective long narrow conductor so that the paired ends of the long narrow conductor form a corresponding one of gaps G2A and G5A and the long narrow conductor forms a quadrangular shape. Note, however, that each of the resonators 142A and 145A has a rectangular shape having long sides extending in parallel with the y-axis direction. FIG. 4 shows, by double-dashed lines, rectangles R2A and R5A respectively corresponding to the center axes of the long narrow conductors constituting the resonators 142A and 145A.

In the resonator 142A, out of the four sides of the rectangle R2A, one side including the gap G2A will be referred to as a side R21A, and the other three sides will be referred to as sides R22A, R23A, and R24A, respectively, in this order from the side R21A in a clockwise direction.

In the resonator 145A, one side including the gap G5A will be referred to as a side R51A, and the other three sides will be referred to as sides R54A, R53A, and R52A, respectively, in this order from the side R51A in a clockwise direction.

The resonator 142A is disposed such that the gap G2A faces a direction closer to the resonator 145A (i.e., the y-axis negative direction). The resonator 145A is disposed such that the gap G5A faces a direction closer to the resonator 142A (i.e., the y-axis positive direction).

In the resonators 142A and 145A, the sides R21A, R23A, R51A, and R53A are short sides, whereas the sides R22A, R24A, R52A, and R54A are long sides.

In the filter 10A, an area occupied by the resonators 141A, 142A, 143, 144, 145A, and 146A has a shorter length in the x-axis direction length, and accordingly an aspect ratio gets closer to 1:1, as compared to those in the filter 10. With this configuration, a bandpass filter in accordance with an aspect of the present invention can be made compact.

Along with adoption of the resonators 142A and 145A each having a rectangular shape, the filter 10A employs the resonators 141A and 146A in place of the resonators 141 and 146. The resonators 141A and 146A respectively include sub sections S122A and S622A, which are longer than those of the resonators 141 and 146. With this configuration, even in a case where the resonators 142A and 145A each having a rectangular shape are employed, it is possible to optimize the strength of coupling between the resonators 141A and 142A and the strength of coupling between the resonators 145A and 146A.

Examples 1 and 2

Figure 5:
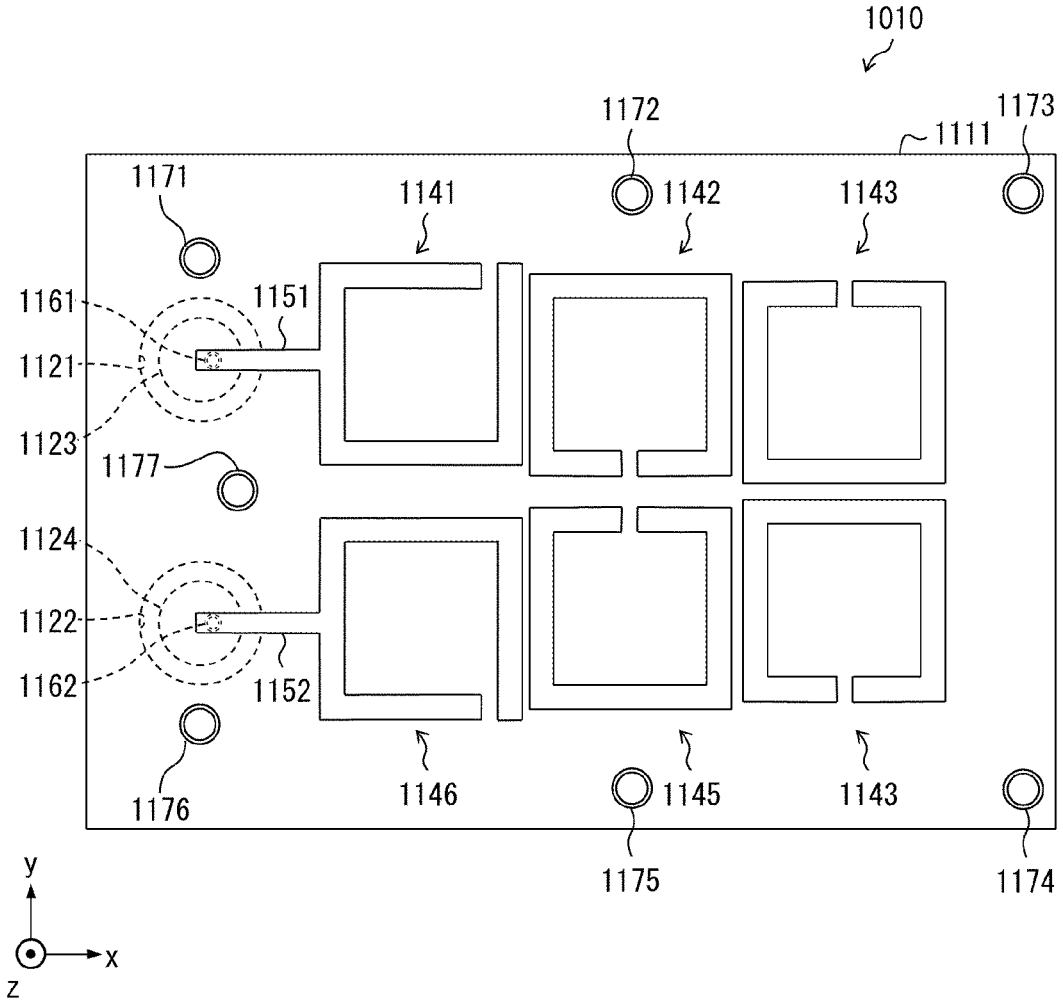
FIG. 5 is a plan view of a plurality of resonators included in a filter in accordance with Comparative Example 1 of the present invention.

Example 1 corresponds to the filter 10 in accordance with Embodiment 1 modified such that the vias 161 and 162 and the anti-pads 121 and 122 formed in the ground conductor layer 12 are omitted, whereas Example 2 corresponds to the filter 10 in accordance with Embodiment 1. Comparative Examples for Examples 1 and 2 are indicated as Comparative Examples 1 and 2, respectively. Comparative Example 1 corresponds to a filter 1010 shown in FIG. 5 modified such that vias 1161 and 1162 and anti-pads 1121 and 1122 formed in one ground conductor layer are omitted. Comparative Example 2 corresponds to the filter 1010 shown in FIG. 5.

When Comparative Examples 1 and 2 are compared with Examples 1 and 2, a substrate 1111, the anti-pads 1121 and 1122, lands 1123 and 1124, resonators 1141 to 1146, lines 1151 and 1152, the vias 1161 and 1162, and through vias 1171 to 1177 are read as the substrate 111, the anti-pads 121 and 122, the lands 123 and 124, the resonators 141 to 146, the lines 151 and 152, the vias 161 and 162, and the through vias 171 to 179 and 1710, respectively.

In Comparative Examples 1 and 2, the resonators 1141 and 1146 each have a square shape similarly to the resonators 1142 to 1145. In addition, a direction in which the line 1151 is drawn out from the resonator 1141 and a direction in which the line 1152 is drawn out from the resonator 1146 are the same (x-axis negative direction). Consequently, a distance between the lines 1151 and 1152 in Comparative Examples 1 and 2 is shorter than a distance between the lines 151 and 152 in Examples 1 and 2. Thus, a distance between (i) the via 1161 and the land 1123 and (ii) the via 1162 and the land 1124 in Comparative Example 2 is shorter than a distance between (i) the via 161 and the land 123 and (ii) the via 162 and the land 124 in Example 2 (see FIG. 5).

In Examples 1 and 2 and Comparative Examples 1 and 2, a long narrow conductor constituting each resonator has a width of 120 μm, each resonator is bent into a square shape having a side of approximately 1 mm, and each of the vias 161, 162, 1161, and 1162 has a diameter of 100 μm.

As shown in FIG. 2, the filter 10 is mounted on the mounting substrate 20 when the filter 10 is actually used. In view of this, Example 2 and Comparative Example 2, each of which includes the lands and vias, are more practical configurations, whereas Example 1 and Comparative Example 1, each of which does not include the lands and vias, are configurations for reference.

(a) to (d) of FIG. 6 respectively show graphs indicating S parameters of Comparative Example 1, Example 1, Comparative Example 2, and Example 2. These S parameters were obtained by simulations. In each of (a) to (d) of FIG. 6, an S parameter S11 is plotted in a solid line, and an S parameter S21 is indicated by a dotted line. Hereinafter, a frequency dependency of the S parameter S11 will be referred to as reflection characteristics, and a frequency dependency of the S parameter S21 will be referred to as transmission characteristics. Herein, the reflection characteristics and the transmission characteristics will be collectively referred to as filter characteristics.

With reference to (a) and (b) of FIG. 6, a comparison was made between Comparative Example 1 and Example 1, each of which does not include the lands and vias. The comparison reveals that both Comparative Example 1 and Example 1 exhibited favorable reflection characteristics and favorable transmission characteristics.

Then, in a case where Comparative Example 1 was modified into Comparative Example 2 by adding the lands 1123 and 1124 and the vias 1161 and 1162, the reflection characteristics and the transmission characteristics were significantly deteriorated (see (c) of FIG. 6).

Meanwhile, in a case where Example 1 was modified into Example 2 by adding the lands 123 and 124 and the vias 161 and 162, the reflection characteristics and the transmission characteristics were less deteriorated than in Comparative Example 2 (see (d) of FIG. 6).

It is considered that these results were obtained due to a phenomenon that a greater distance between pairs of vias and lands can better suppress coupling that may unexpectedly occur between the pairs of vias and lands.

(Variations 2 to 5)

With reference to FIGS. 7 and 8, the following description will discuss Variations 2 to 5, each of which is a variation of the filter 10A in accordance with Variation 1 shown in FIG. 4. Hereinafter, Variation 2 will be referred to as a filter 10A1, Variation 3 will be referred to as a filter 10A2, Variation 4 will be referred to as a filter 10A3, and Variation 5 will be referred to as a filter 10A4. (a) to (d) of FIG. 7 are plan views of pluralities of resonators included in the filters 10A1 to 10A4, respectively. As shown in (d) of FIG. 7, the filter 10A4 is obtained by providing, in the filter 10A shown in FIG. 4 adopted as a base, two additional through vias to a side (a side RS3 shown in (d) of FIG. 7) that is one of the four sides of the rectangle RS surrounding the plurality of resonators which one is closer to the first and second lines. That is, the filter 10A4 includes 12 through vias 171 to 179 and 1710 to 1712. (a) to (d) of FIG. 8 respectively show graphs indicating S parameters of the filters 10A1 to 10A4. These S parameters were obtained by simulations.

Each of the filters 10A1 to 10A3 can be obtained by changing, in the filter 10A4 adopted as a base, the number of sides to which a plurality of through vias are provided. Therefore, in each of (a) to (d) of FIG. 7, reference signs are given only to the rectangle RS surrounding the plurality of resonators, the sides RS1 to RS4, which are the four sides of the rectangle RS, and the plurality of through vias (e.g., in a case of the filter 10A4, the through vias 171 to 179 and 1710 to 1712), whereas no reference sign is given to the other elements.

As shown in (d) of FIG. 7, in the filter 10A4, the through vias 171 to 179 and 1710 to 1712 are provided to all the sides RS1 to RS4 of the rectangle RS. Specifically, the side RS1 is provided with the through vias 171 to 173, the side RS2 is provided with the through vias 177 to 179, the side RS3 is provided with the through vias 1710 to 1712, and the side RS4 is provided with the through vias 174 to 176.

As shown in (a) of FIG. 7, the filter 10A1 can be obtained by omitting, in the filter 10A4 adopted as a base, the through vias 1710 to 1712 provided to the side RS3 and the through vias and 174 to 176 provided to the side RS4. In other words, in the filter 10A1, the plurality of through vias are provided only to the sides RS1 and RS2. The side RS1 is an example of the first side, and the side RS2 is an example of the second side.

As shown in (b) of FIG. 7, the filter 10A2 can be obtained by omitting, in the filter 10A4 adopted as a base, the through vias and 174 to 176 provided to the side RS4. In other words, in the filter 10A2, the plurality of through vias are provided only to the sides RS1, RS2, and RS3. Therefore, in the filter 10A2, the third side is the side RS3, which is closer to the first and second lines.

As shown in (c) of FIG. 7, the filter 10A3 can be obtained by omitting, in the filter 10A4 adopted as a base, the through vias and 1710 to 1712 provided to the side RS3. In other words, in the filter 10A3, the plurality of through vias are provided only to the sides RS1, RS2, and RS4. Therefore, in the filter 10A3, the third side is the side RS4, which is farther from the first and second lines.

It was found with reference to (d) of FIG. 8 that the filter 10A was generally favorable in the reflection characteristics and the transmission characteristics but, at and around 35 GHz in a cutoff band, the filter 10A could not well suppress the S parameter S21 and had a peak thereof.

Meanwhile, with reference to (a) of FIG. 8, the filter 10A1, in which the plurality of through vias are provided to the sides RS1 and RS2, could suppress the S parameter S21 and did not have a peak like the peak occurred in the filter 10A at and around 35 GHz. However, according to a comparison between the filter 10A1 (see (a) of FIG. 8) and the filter 10A4 (see (d) of FIG. 8), it was found that the filter 10A1 poorly suppressed the S parameter S21 at and around 22.8 GHz in a cutoff band.

With reference to (b) and (c) of FIG. 8, it was found that the filter 10A2, in which the plurality of through vias are provided to the sides RS1, RS2, and RS3, and the filter 10A3, in which the plurality of through vias are provided to the sides RS1, RS2, and RS4, could well suppress the S parameter S21 at and around 35 GHz and 22.8 GHz. According to a comparison between the filters 10A2 and 10A3, it was found that the filter 10A2 could suppress the S parameter S21 at and around 35 GHz more favorably.

(Variations of Variations 3 and 4)

With reference to FIGS. 9 and 10, the following description will discuss a configuration obtained by changing, in the filter 10A2 shown in (b) of FIG. 7 adopted as a base, the number of through vias provided to the side RS3 and a configuration obtained by changing, in the filter 10A3 shown in (c) of FIG. 7 adopted as a base, the number of through vias provided to the side RS4. In FIG. 9, (b) shows a plan view of the plurality of resonators included in the filter 10A2, and (e) shows a plan view of the plurality of resonators included in the filter 10A3. (a) of FIG. 9 is a plan view of a plurality of resonators included in a filter 10A2*a*, which is a variation of Variation 3, and (c) of FIG. 9 is a plan view of a plurality of resonators included in a filter 10A2*b*, which is a variation of Variation 3. (d) of FIG. 9 is a plan view of a plurality of resonators included in a filter 10A3*a*, which is a variation of Variation 4, and (f) of FIG. 9 is a plan view of a plurality of resonators included in a filter 10A3*b*, which is a variation of Variation 4. (a) to (f) of FIG. 10 respectively show graphs indicating S parameters of the bandpass filters shown in (a) to (f) of FIG. 9.

As shown in (a) and (c) of FIG. 9, the filter 10A2*a* is configured such that two through vias 1710 and 1712 are provided to the side RS3, and the filter 10A2*b* is configured such that five through vias 1710 to 1714 are provided to the side RS3. As shown in (d) and (f) of FIG. 9, the filter 10A3*a* is configured such that two through vias 174 and 176 are provided to the side RS4, and the filter 10A3*b* is configured such that seven through vias 174 to 176 and 1715 to 1718 are provided to the side RS4.

With reference to (a) to (c) of FIG. 10, the following fact was found: In the filters 10A2, 10A2*a*, and 10A2*b*, in each of which the third side is the side RS3, increasing the number of through vias provided to the side RS3 better suppressed the S parameter S21 in the cutoff band (particularly, in a cutoff band on a higher frequency side).

Meanwhile, with reference to (d) to (f) of FIG. 10, the following fact was found: In the filters 10A3, 10A3*a*, and 10A3*b*, in each of which the third side is the side RS4, increasing the number of through vias provided to the side RS4 hardly affected the transmission characteristics.

(Supplementary Note)

The present invention is not limited to the embodiments, but can be altered by a skilled person in the art within the scope of the claims. The present invention also encompasses, in its technical scope, any embodiment derived by combining technical means disclosed in differing embodiments.

Aspects of the present invention can also be expressed as follows:

A bandpass filter in accordance with a first aspect of the present invention includes: at least one ground conductor layer; a plurality of resonators arranged in a layer spaced from the at least one ground conductor layer, each of the plurality of resonators being made of a long narrow conductor; a first line that is a long narrow conductor connected to a first-pole resonator, which is one of the plurality of resonators; and a second line that is a long narrow conductor connected to a last-pole resonator, which is another one of the plurality of resonators, a direction in which the first line is drawn out from the first-pole resonator and a direction in which the second line is drawn out from the last-pole resonator being opposite to each other.

A bandpass filter configured as above is a type of bandpass filter that is called a strip-line filter or a microstrip filter.

With the above configuration in which the first and second lines are drawn out in opposite directions, one of the ends of the first line which one is not connected to the first-pole resonator and one of the ends of the second line which one is not connected to the last-pole resonator can be distant from each other. Consequently, in a case where a high frequency signal is input, to the first line through a land and a via, from a line formed in a layer that is not the layer in which the plurality of resonators are arranged and the high frequency signal is output from the second line through a via and a land to another line formed in the layer that is not the layer in which the plurality of resonators are arranged, it is possible to reduce coupling that can occur between the land and via on one side and the land and via on the other side. Thus, the above configuration can reduce deterioration in filter characteristics that may occur in a case where the structure of the above type is employed.

A bandpass filter in accordance with a second aspect of the present invention is configured such that, in addition to the feature(s) of the bandpass filter in accordance with the first aspect, (i) the first-pole resonator is made of a first-pole long narrow conductor bent at a first bent point, which is near a midpoint of the first-pole long narrow conductor, so that a first section of the first-pole long narrow conductor which first section includes one end of the first-pole long narrow conductor extends along a second section of the first-pole long narrow conductor which second section includes the other end of the first-pole long narrow conductor, and each of the first and second sections is bent at a respective second bent point, which is near a midpoint of a corresponding one of the first and second sections, so that a first sub section of the corresponding one of the first and second sections which first sub section includes the first bent point is substantially orthogonal to a second sub section of the corresponding one of the first and second sections which second sub section includes a corresponding one of the one end and the other end that are paired, and (ii) the last-pole resonator is made of a last-pole long narrow conductor bent at a first bent point, which is near a midpoint of the last-pole long narrow conductor, so that a first section of the last-pole long narrow conductor which first section includes one end of the last-pole long narrow conductor extends along a second section of the last-pole long narrow conductor which second section includes the other end of the last-pole long narrow conductor, and each of the first and second sections is bent at a respective second bent point, which is near a midpoint of a corresponding one of the first and second sections, so that a first sub section of the corresponding one of the first and second sections which first sub section includes the first bent point is substantially orthogonal to a second sub section of the corresponding one of the first and second sections which second sub section includes a corresponding one of the one end and the other end that are paired, the first-pole resonator and the last-pole resonator are arranged such that (i) the first sub sections of the first-pole resonator and the first sub sections of the last-pole resonator extend in parallel with each other and (ii) a direction in which the second sub sections of the first-pole resonator extend and a direction in which the second sub sections of the last-pole resonator extend are opposite to each other, and the first line is connected to a part of the first section of the first-pole long narrow conductor which part is near the first bent point of the first-pole long narrow conductor, and the second line is connected to a part of the first section of the last-pole long narrow conductor which part is near the first bent point of the last-pole long narrow conductor.

With the above configuration, it is possible to easily draw out the first line from the first-pole resonator and the second line from the last-pole resonator in opposite directions, while allowing the first line to be connected to the part of the first section of the first-pole long narrow conductor which part is near the first bent point of the first-pole long narrow conductor and allowing the second line to be connected to the part of the first section of the last-pole long narrow conductor which part is near the first bent point of the last-pole long narrow conductor.

A bandpass filter in accordance with a third aspect of the present invention is configured such that, in addition to the feature(s) of the bandpass filter in accordance with the first or second aspect, the bandpass filter further including: a multilayer substrate including a plurality of plate-like members each made of a dielectric; and a first via and a second via provided to the multilayer substrate, wherein the at least one ground conductor layer is provided to an outer layer of the multilayer substrate, the plurality of resonators are provided in an inner layer of the multilayer substrate, the at least one ground conductor layer includes a ground conductor layer having a first anti-pad and a second anti-pad, the first anti-pad surrounding, in a plan view, an area overlapping a first end out of ends of the first line which first end is not connected to the first-pole resonator, the second anti-pad surrounding, in a plan view, an area overlapping a second end out of ends of the second line which second end is not connected to the last-pole resonator, the first via allows a first land and the first end to be short-circuited to each other, the first land being an area surrounded by the first anti-pad, and the second via allows a second land and the second end to be short-circuited to each other, the second land being an area surrounded by the second anti-pad.

With the above configuration, each of the first and second lands can be used as an input-output port so that the bandpass filter in accordance with this aspect can be easily connected to another line.

A bandpass filter in accordance with a fourth aspect of the present invention is configured such that, in addition to the feature(s) of the bandpass filter in accordance with any one of the first to third aspects, the at least one ground conductor layer includes paired ground conductor layers facing each other, and the plurality of resonators are interposed between the paired ground conductor layers.

With the above configuration, the plurality of resonators are sandwiched between the paired ground conductor layers, and therefore the paired ground conductor layers can shield the plurality of resonators from the outside.

A bandpass filter in accordance with a fifth aspect of the present invention is configured such that, in addition to the feature(s) of the bandpass filter in accordance with the fourth aspect, the bandpass filter further including: a multilayer substrate including a plurality of plate-like members each made of a dielectric and paired outer layers respectively provided with the paired ground conductor layers; and a plurality of through vias that are provided to the multilayer substrate and that allows the paired ground conductor layers to be short-circuited to each other, wherein the plurality of resonators are provided in an inner layer of the multilayer substrate, and in a plan view, the plurality of through vias are arranged along three sides out of four sides of a rectangle surrounding the plurality of resonators, the three sides including a first side close to the first end out of the ends of the first line which first end is not connected to the first-pole resonator and a second side close to the second end out of the ends of the second line which second end is not connected to the last-pole resonator.

With the above configuration, the paired ground conductor layers are short-circuited to each other by the plurality of through vias. Consequently, it is possible to reduce an electric potential difference between the paired ground conductor layers. The bandpass filter in accordance with this aspect can suppress the transmission characteristics in a cutoff band, as compared to a bandpass filter configured such that a plurality of through vias are provided only to first and second sides and a bandpass filter configured such that a plurality of through vias are provided to four sides.

A bandpass filter in accordance with a sixth aspect of the present invention is configured such that, in addition to the feature(s) of the bandpass filter in accordance with the fifth aspect, the three sides includes a third side, which is one of two sides of the four sides other than the first side and the second side, the one of the two sides being closer to the first and second lines than is the other of the two sides.

With the above configuration, it is possible to better suppress the transmission characteristics in a cutoff band on a high frequency side, as compared to a configuration in which the third side is a side farther from the first and second lines.

A bandpass filter in accordance with a seventh aspect of the present invention is configured such that, in addition to the feature(s) of the bandpass filter in accordance with any one of the first to sixth aspects, the plurality of resonators are each made of a long narrow conductor bent so that paired ends of the long narrow conductor have a gap therebetween, and the plurality of resonators are arranged in two rows and three columns, a resonator disposed on a first row and a first column is a first resonator, a resonator disposed on the first row and a second column is a second resonator, a resonator disposed on the first row and a third column is a third resonator, a resonator disposed on a second row and the third column is a fourth resonator, a resonator disposed on the second row and the second column is a fifth resonator, and a resonator disposed on the second row and the first column is a sixth resonator, the first resonator is the first-pole resonator, and the sixth resonator is the last-pole resonator, and the first to sixth resonators are arranged such that a linear section of an i-th resonator and a linear section of an i+1-th resonator are close to each other and a gap of the second resonator and a gap of the fifth resonator are close to each other, where i is an integer of not less than 1 and not more than 5.

With the above configuration, the i-th resonator and the i+1-th resonator can be coupled to each other mostly magnetically, and the second resonator and the fifth resonator can be coupled to each other mostly electrostatically. Thus, the bandpass filter in accordance with this aspect is likely to achieve desired filter characteristics.

A bandpass filter in accordance with an eighth aspect of the present invention is configured such that, in addition to the feature(s) of the bandpass filter in accordance with any one of the first to seventh aspects, the plurality of resonators, the first line, and the second line are arranged so as to have line symmetry.

With the above configuration, the bandpass filter can be made more symmetric. Therefore, it is possible to reduce design parameters. This makes it easier to design the bandpass filter in accordance with this aspect, as compared to a bandpass filter including a plurality of resonators, a first line, and a second line arranged not in line symmetry.

REFERENCE SIGNS LIST

10, 10A, 10A1, 10A2, 10A3, 10A2*a*, 10A2*b*, 10A3*a*, 10A3*b*: Filter (bandpass filter)
11: Multilayer substrate
111, 112: Substrate (plate-like member)
LI1: Inner layer
LO11, LO12: Outer layer
12: Ground conductor layer
121, 122: Anti-pad (first anti-pad, second anti-pad)
123, 124: Land (first land, second land)
13: Ground conductor layer
141, 141A: Resonator (first-pole resonator, first resonator)
P11, P12: Bent point (first bent point, second bent point)
S11, S12: Section (first section, second section)
E11, E12: End (one end, the other end)
S111, S121: Sub section (first sub section)
S112, S122: Sub section (second sub section)
PC1: Connection point
142 to 145: Resonator (second resonator, third resonator, fourth resonator, fifth resonator)
142A, 145A: (second resonator, fifth resonator)
146, 146A: Resonator (last-pole resonator, sixth resonator)
P61, P62: Bent point (first bent point, second bent point)
G1 to G6, G2A, GSA: Gap
S61, S62: Section (first section, second section)
E61, E62: End (one end, the other end)
S611, S621: Sub section (first sub section)
S612, S622: Sub section (second sub section)
PC6: Connection point
R2, R3, R4, R5: Square
R2A, R5A: Rectangle
R21 to R24, R31 to R34, R41 to R44, R51 to R54, R21A to R24A, R51A to R54A: Side
151, 152: Line (first line, second line)
1511, 1521: End (first end, second end)
161, 162: Via (first via, second via)
171 to 179, 1710 to 1718: Through vias (a plurality of through vias)
RS: Rectangle
RS1, RS2, RS3: First side, second side, third side
AS: Symmetric axis

The invention claimed is:

1. A bandpass filter comprising: at least one ground conductor layer;

a plurality of resonators arranged in a layer spaced from said at least one ground conductor layer, each of the plurality of resonators being made of a long narrow conductor;

a first line that is a long narrow conductor connected to a first-pole resonator, which is one of the plurality of resonators; and a second line that is a long narrow conductor connected to a last-pole resonator, which is another one of the plurality of resonators, a direction in which the first line is drawn out from the first-pole resonator and a direction in which the second line is drawn out from the last-pole resonator being opposite to each other, wherein (i) the first-pole resonator is made of a first-pole long narrow conductor bent at a first bent point, which is near a midpoint of the first-pole long narrow conductor, so that a first section of the first-pole long narrow conductor which first section includes one end of the first-pole long narrow conductor extends along a second section of the first-pole long narrow conductor which second section includes the other end of the first-pole long narrow conductor, and each of the first and second sections is bent at a respective second bent point, which is near a midpoint of a corresponding one of the first and second sections, so that a first sub section of the corresponding one of the first and second sections which first sub section includes the first bent point is substantially orthogonal to a second sub section of the corresponding one of the first and second sections which second sub section includes a corresponding one of the one end and the other end that are paired, and (ii) the last-pole resonator is made of a last-pole long narrow conductor bent at a first bent point, which is near a midpoint of the last-pole long narrow conductor, so that a first section of the last-pole long narrow conductor which first section includes one end of the last-pole long narrow conductor extends along a second section of the last-pole long narrow conductor which second section includes the other end of the last-pole long narrow conductor, and each of the first and second sections is bent at a respective second bent point, which is near a midpoint of a corresponding one of the first and second sections, so that a first sub section of the corresponding one of the first and second sections which first sub section includes the first bent point is substantially orthogonal to a second sub section of the corresponding one of the first and second sections which second sub section includes a corresponding one of the one end and the other end that are paired, the first-pole resonator and the last-pole resonator are arranged such that (i) the first sub sections of the first-pole resonator and the first sub sections of the last-pole resonator extend in parallel with each other and (ii) a direction in which the second sub sections of the first-pole resonator extend and a direction in which the second sub sections of the last-pole resonator extend are opposite to each other, and the first line is connected to a part of the first section of the first-pole long narrow conductor which part is near the first bent point of the first-pole long narrow conductor, and the second line is connected to a part of the first section of the last-pole long narrow conductor which part is near the first bent point of the last-pole long narrow conductor.

2. The bandpass filter as set forth in claim 1, further comprising:

a multilayer substrate including a plurality of plate-shaped members each made of a dielectric;

and a first via and a second via provided to the multilayer substrate, wherein said at least one ground conductor layer is provided to an outer layer of the multilayer substrate, the plurality of resonators are provided in an inner layer of the multilayer substrate, said at least one ground conductor layer comprises a ground conductor layer having a first anti-pad and a second anti-pad, the first anti-pad surrounding, in a plan view, an area overlapping a first end out of ends of the first line which first end is not connected to the first-pole resonator, the second anti-pad surrounding, in a plan view, an area overlapping a second end out of ends of the second line which second end is not connected to the last-pole resonator, the first via allows a first land and the first end to be short-circuited to each other, the first land being an area surrounded by the first anti-pad, and the second via allows a second land and the second end to be short-circuited to each other, the second land being an area surrounded by the second anti-pad.

3. The bandpass filter as set forth in claim 1, wherein the plurality of resonators are each made of a long narrow conductor bent so that paired ends of the long narrow conductor have a gap therebetween, and the plurality of resonators are arranged in two rows and three columns, a resonator disposed on a first row and a first column is a first resonator, a resonator disposed on the first row and a second column is a second resonator, a resonator disposed on the first row and a third column is a third resonator, a resonator disposed on a second row and the third column is a fourth resonator, a resonator disposed on the second row and the second column is a fifth resonator, and a resonator disposed on the second row and the first column is a sixth resonator, the first resonator is the first-pole resonator, and the sixth resonator is the last-pole resonator, and the first to sixth resonators are arranged such that a linear section of an i-th resonator and a linear section of an i+1-th resonator are close to each other and a gap of the second resonator and a gap of the fifth resonator are close to each other, where i is an integer of not less than 1 and not more than 5.

4. The bandpass filter as set forth in claim 1, wherein the plurality of resonators, the first line, and the second line are arranged so as to have line symmetry.

5. The bandpass filter as set forth in claim 1, wherein said at least one ground conductor layer comprises paired ground conductor layers facing each other, and the plurality of resonators are interposed between the paired ground conductor layers.

6. The bandpass filter as set forth in claim 5, further comprising: a multilayer substrate including a plurality of plate-shaped members each made of a dielectric and paired outer layers respectively provided with the paired ground conductor layers; and a plurality of through vias that are provided to the multilayer substrate and that allows the paired ground conductor layers to be short-circuited to each other, wherein the plurality of resonators are provided in an inner layer of the multilayer substrate, and in a plan view, the plurality of through vias are arranged along three sides out of four sides of a rectangle surrounding the plurality of resonators, the three sides including a first side close to the first end out of the ends of the first line which first end is not connected to the first-pole resonator and a second side close to the second end out of the ends of the second line which second end is not connected to the last-pole resonator.

7. The bandpass filter as set forth in claim 6, wherein the three sides includes a third side, which is one of two sides of the four sides other than the first side and the second side, the one of the two sides being closer to the first and second lines than is the other of the two sides.

* * * * *